United States Patent [19]

Irving

[11] Patent Number: 4,682,424

[45] Date of Patent: Jul. 28, 1987

[54] CLOTHES DRYING APPARATUS

[76] Inventor: Arlillian Irving, 5813 Bonnieview, #1135, Dallas, Tex. 75241

[21] Appl. No.: 919,799

[22] Filed: Oct. 16, 1986

[51] Int. Cl.[4] ..... F26B 9/06

[52] U.S. Cl. ..... 34/151; 34/202; 34/233; 211/123; 312/229; 312/273; 223/93

[58] Field of Search ..... 211/113, 119, 123, 94; 312/229, 321, 273, 3, 4; 223/93; 34/151, 202, 233

[56] References Cited

U.S. PATENT DOCUMENTS

| | | | |
|---|---|---|---|
| 380,949 | 4/1888 | Shannon . | |
| 747,787 | 12/1903 | Smith . | |
| 1,168,722 | 1/1916 | Guano . | |
| 1,755,013 | 4/1930 | McCormick . | |
| 1,759,179 | 5/1930 | Wiesman . | |
| 1,767,157 | 6/1930 | Steele . | |
| 1,833,631 | 11/1931 | Wilsey . | |
| 1,866,987 | 7/1932 | Principessa et al. . | |
| 2,221,351 | 11/1940 | Kempf | 34/28 |
| 2,385,628 | 9/1945 | Larkin et al. | 18/6 |
| 2,463,218 | 3/1949 | Travis | 34/60 |
| 2,645,863 | 7/1953 | Morrison | 34/239 |
| 2,668,368 | 2/1954 | Jacobs | 34/151 |
| 2,773,314 | 12/1956 | Gauff | 34/91 |
| 2,856,700 | 10/1958 | Wales | 34/91 |
| 3,140,024 | 7/1964 | Burns et al. | 223/93 |
| 3,432,939 | 3/1969 | Eichholz | 34/151 |
| 3,739,496 | 6/1973 | Buckley et al. | 34/210 |
| 3,866,336 | 2/1975 | Bereza | 34/163 |
| 3,905,125 | 9/1975 | Hubner | 34/151 |
| 4,625,432 | 12/1986 | Baltes | 34/151 |

FOREIGN PATENT DOCUMENTS

| | | | |
|---|---|---|---|
| 1116286 | 5/1956 | France | 34/151 |

*Primary Examiner*—Larry I. Schwartz

*Attorney, Agent, or Firm*—Richards, Harris, Medlock & Andrews

[57] ABSTRACT

The present invention relates to an apparatus for drying hanger mounted clothes, comprising a hanger rod mounted above a drip pan element, where said rod and drip pan assembly may be slidably removed from a drying cabinet so that wet clothing articles may be easily mounted on the hanger rod. In another aspect, the present invention relates to an improved clothing hanger having at least one clothing clip adapted so as to retain an article of clothing to prohibit said article from being removed from said hanger during operations, where said clothing clip may be attached to said hanger by an extension wire. In another aspect, an automatic control is provided so that the drying cycle may be preselected so as to achieve the most efficient drying of the clothing articles.

7 Claims, 3 Drawing Figures

FIG. 2
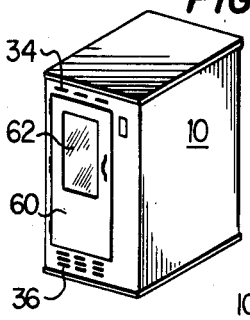
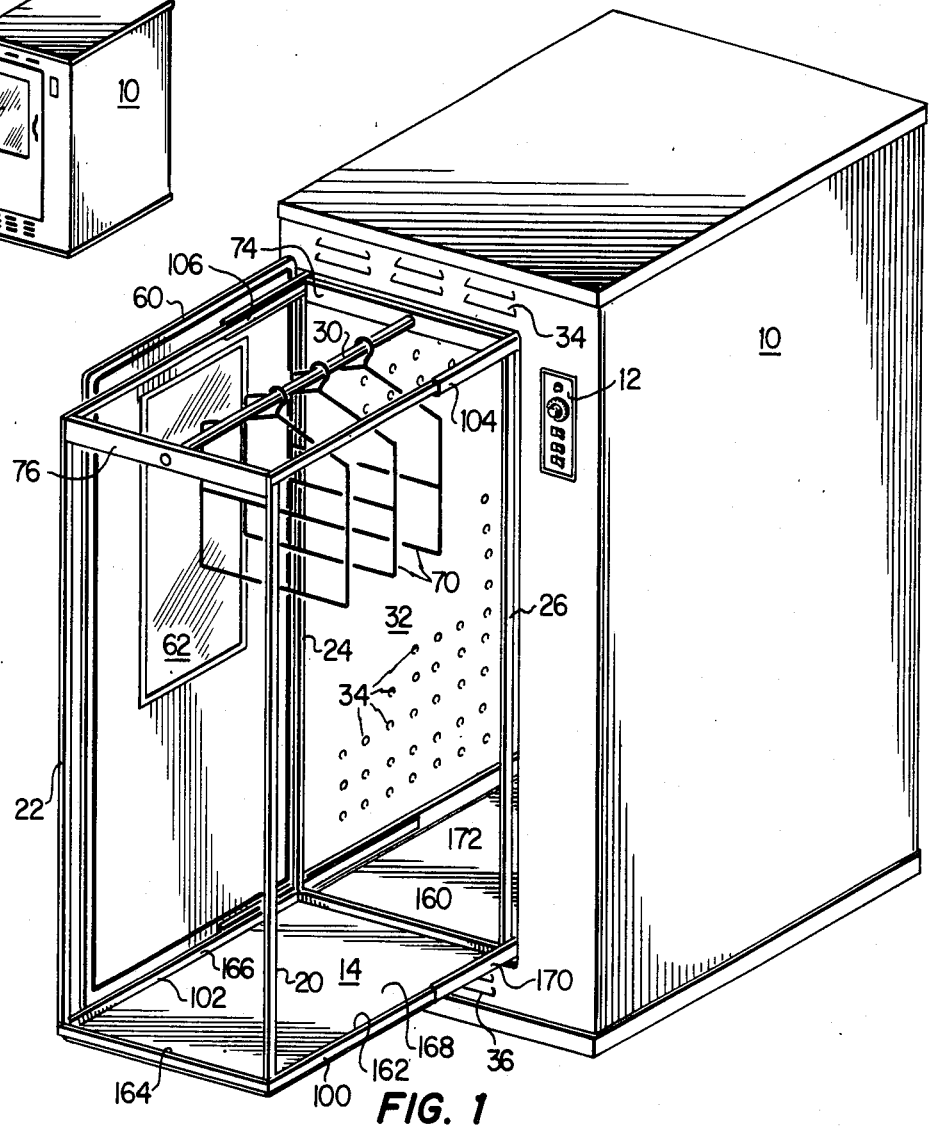
FIG. 1
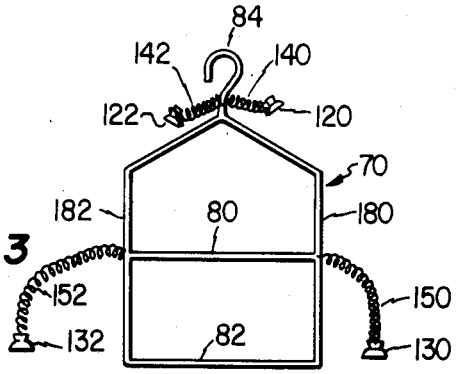
FIG. 3

CLOTHES DRYING APPARATUS

TECHNICAL FIELD

The present invention relates to an apparatus for drying hanger mounted clothes, which includes a drip pan element to collect excess water and includes improved hangers to retain clothing articles during drying operations.

BACKGROUND ART

It is well known to dry clothes after washing in tumble-type dryer. However, tumble dryers suffer the disadvantage of permanently wrinkling clothes of certain fabrics. In particular, the tumble dryers of the prior art tend to wrinkle permanent press clothing if the clothing is not promptly removed from the dryer after it completes its cycle. Consequently, the operator is required to be present when the dryer completes its cycle to remove clothing therefrom resulting in an inconvenience to the operator. Further, tumble dryers produce wrinkles in clothes by the very nature of the tumbling cycle.

The prior art also contemplates the use of a clothes drying machine wherein the articles to be dried are mounted on a hanger or rack to allow hot turbulent air to be circulated around the clothing article to affect its drying. In particular, U.S. Pat. No. 380,949 issued to Shannon discloses a clothes dryer wherein a plurality of clothes racks are mounted as drawers in a cabinet structure, the cabinet providing means to heat and circulate air around clothing mounted on the plurality of racks to affect drying thereof. Other devices contemplate clothing mounted on a hanger and stretched over a vent aperture to allow hot air to be forced into the interior of a wet clothing article to affect drying thereof. Examples of these devices are disclosed in U.S. Pat. No. 759,179 issued to Wiesman.

The prior art also contemplates horizontally mounted clothes racks, mounted so as to be extended from the clothes drying machine to allow easy access thereto. Further, the prior art devices contemplate the use of a drip pan mounted directly beneath the above described clothing rack to collect excess water dripping from wet clothing articles prior to the completion of the drying step. Examples of these devices are disclosed in U.S. Pat. No. 3,866,336 issued to Bereza.

The devices of the prior art suffer the disadvantages of having no adequate means to attach clothing articles to the clothing rack to prohibit the article from being blown off of the rack when exposed to forceful gusts of hot drying air. Further, the devices of the prior art, while suggesting the use of drip pans, have no means to link the drip pan to the rack fixture to assure that the drip pan is under the wet clothing article at all times during the loading and drying operations. Further, the devices of the prior art fail to provide an easy means of both loading and unloading clothing articles from the drying cabinet while simultaneously providing a drip pan to collect all excess water from the clothing articles during the loading and drying operations.

SUMMARY OF THE INVENTION

The present invention comprises an apparatus for drying clothing wherein the clothing is vertically mounted on hangers adapted to secure the clothing articles to prohibit their being removed from the hanger during drying operations. Specifically, the present invention contemplates the use of forceful gusts of hot dry air to affect drying of wet clothing articles and provides clip means to removably attach clothing articles to a hanger adapted to assure that the clothing article remains mounted in a vertical position during the drying operation. Further, the present invention provides a means wherein a drip pan is deployed beneath wet clothing articles at all times during the loading, drying, and removal steps.

BRIEF DESCRIPTION OF THE DRAWINGS

A more complete understanding of the invention and its advantages will be apparent from the Detailed Description taken in conjunction with the accompanying Drawings, in which:

FIG. 1 is a perspective view of the apparatus of the present invention;

FIG. 2 is a perspective view of the apparatus as shown in FIG. 1; and

FIG. 3 is a side view of one aspect of the apparatus of the present invention.

DETAILED DESCRIPTION

Referring to FIG. 1, the present invention comprises a cabinet 10 having a door 60. Cabinet 10 houses either a gas or electric air heater and air blower or pump (not shown) as are used in the prior art to generate and move heated air to affect the drying of wet clothing. In particular, cabinet 10 has interior wall 32 having a plurality of air holes 34 through which the heated air is forced into the interior of the cabinet. It will be understood that the other interior walls of cabinet 10 likewise have air holes to allow heated air to injected into the interior of the cabinet.

It will be understood that the apparatus of the present invention accomplishes the drying of clothing in a manner similar to the dryers of the prior art, wherein hot dry air is forced across the surface of the wet clothing articles to cause evaporation of water contained in the articles, removing the water therefrom and transporting the water from the drying apparatus through an exhaust. The present invention contemplates an electric or gas heating element used to heat ambient air to a sufficient temperature to affect proper drying operations without damaging the clothing articles, and further contemplates the use of a blower or pump of a sufficient strength to move the heated air in a sufficient quantity to realize an efficient drying of the clothing articles. It will be further understood that the heated air may be blown across the clothing articles in a single jet, or in a plurality of jets or high velocity streams, or may be circulated about the wet clothing articles in a more gentle fashion by various blower apertures. In particular, the present invention contemplates the employment of perforations 34 located about the interior of the cabinet, where the hot dry air is emitted from the perforations to contact the surfaces of the wet clothing articles in a vigorous fashion, and then move towards an exahust duct (not shown) to be removed from the cabinet.

Cabinet 10 has control mechanism 12 which allows the user to preset the temperature at which the clothing articles will be dried and to preset the time of the drying operation so as to control the clothing's exposure to the heated air. Control 12 also permits the user to control the velocity at which air is injected into the interior of cabinet 10 through air holes 34 so as to better effect the drying of the clothing articles.

Slidably mounted in the interior of cabinet 10 is a drying rack comprising hangers 70 mounted on a hanger rod 30 and drip pan 14 mounted beneath the hangers. In particular, the hanger rod and drip pan are connected by vertical supports 20, 22, 24 and 26, where drip pan 14 is mounted on slides 170 and 172 and comprises a base 168 with sides 160, 162, 164 and 166. Hanger rod 30 is connected between cross members 74 and 76 which in turn are connected to slides 104 and 106. It will be understood that slides 104, 106, 170 and 172 may be of any configuration as suitable for the present application, and in the preferred embodiment contain ball bearings or wheels mounted so as to reduce the friction experienced during sliding operations. The combination of hanger rod 30, cross members 74 and 76, and slides 104 and 106 may be referred to, generally, as a hanger rod assembly. Further, it will be understood that drip pan 14 may comprise any means to receive and retain a liquid, such as a substantially rectangular pan as shown, and generally, this liquid collection means may be referred to as a drip pan assembly.

Slides 104, 106, 170 and 172 are located so as to assure that vertical supports 20, 22, 24 and 26 remain in a substantially vertical position when hanger rack 30 and drip pan 14 are located on the outside of cabinet 10 and when the rack and drip pan are inserted into the drying cabinet.

Referring now to FIG. 2, door 60 is shown in a closed position, and has window 62 through which the operator can observe drying operations. Further, cabinet 10 has air inlets 34 located above door 60 and inlets 36 located below door 60 through which cool ambient air is drawn to be heated and injected into the interior of cabinet 10, then vented through an exhaust (not shown). It will be understood that when door 60 is in its closed position, cabinet 10 is sealed so as to provide an efficient drying operation. Further, the present invention contemplates the use of a safety switch mounted on door 60 so that when the door is open during operation the heating cycle is interrupted to permit the user to remove the rack and drip pan assembly from the cabinet and either retrieve partially dried clothing articles from the rack or load more clothing articles thereon at mid cycle. The present invention further contemplates that the hanger assembly and other metal surfaces be coated with a suitable material, such as plastic, so that the human operator will not be burned or injured in any other way when contacting the metal surfaces at mid cycle or at the completion of a drying cycle.

Referring now to FIG. 3, in another aspect, the present invention contemplates the use of a clothing hanger adapted to prohibit clothing articles from being removed therefrom during drying operations by the force of air. In particular, hanger 70 has extensions 180 and 182 which are linked by cross members 80 and 82 so as to form a substantially rectangular hanger structure. Proximate to hanger hook 84 are clothing clips 120 and 122 attached to hanger 70 by extension wires 140 and 142. Proximate to the locations at which cross member 80 connects to extensions 180 and 182 are clothing clips 130 and 132 attached to the extensions by wire extensions 150 and 152. It will be understood that this improved hanger structure will allow clothing articles to be filled by warm drying air, but will prohibit the clothing article from being removed from the hanger by the force of the drying air. The improved hanger of the present invention avoids the problems associated with the prior art cabinet dryers wherein the clothing articles were removed from the drying hangers, falling to the floor of the cabinet, and thereby remaining undried through the completion of the drying cycle.

It will be further understood that the present invention contemplates the improved hanger structure to be manufactured in a variety of sizes and shapes so as to better retain articles of clothing during drying operations. For example, in one embodiment, hanger 70 is of a suitable size and shape so as to receive and retain a man's shirt, while alternative embodiments may be of an elongate length and narrow width so as to receive and retain a pair of man's pants in a fully extended position to facilitate drying operations. In yet another alternative embodiment, hanger 70 may be of suitable dimensions so as to receive and retain a woman's full length dress in an extended position so that air may pass over the surface of the dress to allow effective drying. Generally, the hanger structure contemplated by this invention may be of rectangular, trapezoidal, or triangular shape, or may be of such a shape that employs rectangular, trapezoidal, and triangular elements in such a fashion so that the hanger will be properly sized and shaped to receive and retain specific types of articles of clothing. It will be further understood that all hangers contemplated by the present invention may employ clothing clips and wire extensions as shown in FIG. 3 so as to prohibit the clothing article from being removed from the hanger by the force of the drying air.

In operation, the operator removes wet clothing articles from a washing machine and mounts them on hangers 70 by hanging the clothing over the hanger and attaching clothing clips 120, 122, 130 and 132 to the clothing at suitable places. It will be understood that wet clothing articles should have their buttons or zippers fastened when placed over hanger 70 so that the wet clothing article will completely encase the hanger to the greatest extent possible. This aspect of mounting wet clothing articles on hangers 70 assures that the hanger will be most effective in allowing warm drying air to be circulated over the entire surface of the clothing article, without the unwanted effect of having the clothing article bunch up or in some other way fold over upon itself during drying operations from the vigorous gusts of warm air blown upon the clothing article.

Door 60 of cabinet 10 is opened, and the hanger rod and drip pan assembly is slidably extended from the cabinet to allow access to the hanger rod. The loaded hangers are then hung on rod 30 and all excess water in the clothing is allowed to drip onto pan 14. Pan 14 serves to avoid the clothing dripping onto the floor area immediately in front of cabinet 10, thereby avoiding the danger of a person slipping on the wet floor after door 60 is closed. It will be understood that pan 14 may have a drain (not shown) so that excess water is removed from the pan and drying cabinet prior to the initiation of the drying operation.

After the operator determines that substantially all excess water has been drained from the clothing articles the rod and pan structure is slid into cabinet 10 and door 60 is closed so as to seal the cabinet to prohibit any warm air from escaping therefrom. The operator may then preselect the temperature at which the clothes will be dried, where, for instance, higher temperatures may used to dry cotton fabrics, and lower temperatures used to dry permanent press fabrics. Further, the blower speed may be preselected to allow the clothes to be dried in a vigorous fashion by air moving at a high velocity or dried in a more modest fashion by lower velocity air. Further, the operator may preselect the amount of time he or she desires the dryer to be in operation, and uses his or her experience to best estimate the amount of time necessary to dry a particular load of clothing.

The drying cycle may be interrupted at any time by opening door 60, and hanger rod 30 and drip pan 14 may be slidably removed from the interior of the cabinet so as to allow the operator to either remove or add new clothing articles to rod 30 at mid cycle. It will understood that the drying operations may be observed through window 62 located in door 60 so that the operator may judge when the clothing is reasonably dry by observing the clothing through the window.

Although preferred embodiments of the invention have been described in the foregoing Detailed Description and illustrated in the accompanying Drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications, and substitutions of parts and elements as fall within the scope of the invention.

I claim:

1. A clothes drying apparatus comprising:

a cabinet structure having an interior;

a hanger rod assembly;

a drip assembly, wherein said hanger rod assembly and drip pan assembly are slidably mounted within said interior of said cabinet structure so that said hanger rod assembly and said drip pan assembly each have a first position located within said cabinet structure and each have a second position located partially outside of said cabinet structure; and further comprising a means connecting said hanger rod assembly and said drip pan assembly so that said hanger rod assembly and said drip pan assembly may be moved from their first positions to their second positions in a coordinated fashion, where said drip pan assembly remains in a location substantially beneath said hanger rod assembly when said rod and drip pan assemblies are in their first positions and their second positions.

2. The clothes drying apparatus of claim 1, wherein said drip pan assembly comprises a substantially rectangular pan shaped so as to receive and retain a liquid, wherein said connection means comprises a vertical support having first and second ends, wherein the first end of said vertical support is attached to said hanger rod assembly and said second end of said vertical support is attached to said drip pan assembly.

3. The clothes drying apparatus of claim 1, further comprising a port located in said cabinet structure, said port sized to allow passage of said hanger rod assembly and drip pan assembly from their first positions to their second positions, and further comprising a door structure having open and closed positions, and attached to said cabinet and sized to seal said port when said door is in its closed position so as to prohibit passage of air either into or out of the interior of said drying cabinet.

4. The clothes drying apparatus of claim 3 further comprising a heating means adapted to heat ambient air to a temperature sufficient to effect the drying of clothing articles, and a blower means adapted to circulate said heated air within the interior of said cabinet structure about wet clothing articles to effect their drying.

5. The clothes drying apparatus of claim 4 further comprising a control means whereby the operation of said heater and blower means may be controlled and preset by the user to effect the drying of wet clothing articles.

6. The clothes drying apparatus of claim 1, wherein said hanger rod assembly is adapted to receive a hanger structure, said hanger structure having at least one clip adapted to removably retain an article of clothing, said clip attached to said hanger by an extension wire so as to prohibit said clothing article from being removed from said hanger during drying operations, wherein said hanger structure further comprises dual extensions having at least a single cross member so as to form a rectangular hanger body adapted to prohibit a clothing article from being removed from said hanger during said drying operations.

7. The clothes drying apparatus of claim 1, further comprising a hanger structure adapted to be mounted on said hanger rod assembly, wherein said hanger structure comprises dual extensions having at least a single cross member so as to form a rectangular hanger body adapted to prohibit a clothing article from being removed from said hanger during said drying operations, wherein said rectangular hanger body is sized to receive and retain a clothing article so as to prohibit said article from being removed from said hanger during said drying operations, and to permit efficient drying operations.

* * * * *